United States Patent [19]

Larsen et al.

[11] 3,945,093

[45] Mar. 23, 1976

[54] METHOD AND APPARATUS FOR PRODUCING HIGH MODULUS BIAXIAL FABRIC

[75] Inventors: Richard J. Larsen, Torrance; Robert W. Mitchell, Hawthorne, both of Calif.

[73] Assignee: Hitco, Irvine, Calif.

[22] Filed: June 10, 1974

[21] Appl. No.: 477,599

[52] U.S. Cl. ..... 26/68; 8/115.5; 68/5 D

[51] Int. Cl.[2] ..... D06C 3/00

[58] Field of Search ..... 26/54, 63, 68; 23/260, 23/262, 209.1 F, 209.4; 8/115.5; 264/DIG. 1, 19, 29, 288; 263/3 US; 68/5 D, 115.5 US

[56] References Cited

UNITED STATES PATENTS

| | | | |
|---|---|---|---|
| 2,824,383 | 2/1958 | Machalek | 26/68 X |
| 2,884,015 | 4/1959 | Bechter | 26/63 X |
| 3,243,845 | 4/1966 | Cassel | 26/54 |
| 3,474,509 | 10/1969 | Bray | 26/54 X |
| 3,517,425 | 6/1970 | Hunter | 26/54 |
| 3,803,672 | 4/1974 | McGuffin et al. | 26/68 |

*Primary Examiner*—Louis K. Rimrodt
*Attorney, Agent, or Firm*—Marvin E. Jacobs

[57] ABSTRACT

The transverse properties of high modulus fabric such as graphite are significantly improved by continuously processing the material through a multiple roller unit under warp tension while restraining fill shrinkage by wrapping the material no less than 180° around each roll and by minimizing unrestrained inter-roll travel by controlling the inter-roll span. Graphite precursor fabrics such as polyacrylonitrile (PAN) can be stretched as high as 45% in the warp direction with as little as 1–2% shrinkage in the fill direction. The invention also relates to simultaneous stretching and preoxidation of the precursor fabric under tension and while minimizing fill shrinkage.

10 Claims, 5 Drawing Figures

METHOD AND APPARATUS FOR PRODUCING HIGH MODULUS BIAXIAL FABRIC

BACKGROUND OF THE INVENTION

1. Field of the Invention

The present invention relates to the manufacture of biaxial high modulus materials and, more particularly, to methods and apparatus for continuously converting woven PAN fabric to carbon and graphite products.

2. Description of the Prior Art

High modulus graphite has been available for several years but has not received wide usage because of the high cost and limited availability of the material. Graphite is presently being produced in continuous or discontinuous lengths as fiber filament or yarn. Continuous fiber has a very high cost due to the very high temperatures required for processing coupled with a tendency of the fiber to break during processing under tension and the need for a separate train of equipment for each yarn being processed. The breaking tendency has further precluded the continuous processing of prewoven precursor material.

U.S. Pat. No. 3,803,672 discloses a continuous web process and apparatus for manufacturing high modulus graphite fabric in which precursor fabric is incrementally stretched dynamically followed by preoxidation and graphitization. The application mainly dealt with control of production parameters to develop the high modulus properties in the warp direction of the fabric and the control of the parameters of time, temperature, tension and atmosphere composition during preoxidation to optimize the warp properties while minimizing the possibility of breakage.

SUMMARY OF THE INVENTION

It has now been discovered in accordance with the invention that the transverse or fill direction properties of high modulus graphite fabric can be significantly improved by continuously processing the precursor material through a multiple roller unit under tension while restraining fill shrinkage. Fill shrinkage control has not been considered practical because edge restraining devices would be difficult to implement under the high temperature processing necessary and due to the fragility of the fabric.

However, in accordance with the invention, fill shrinkage is minimized by wrapping the material no less than 180° around each roll of a multiple roll unit and by minimizing the unrestrained, free, inter-roll travel by spacing the rolls closely together. The invention also relates to the combination of the steps of stretching and preoxidation in an S-wrap multiple roll unit under warp tension.

Graphite precursors such as polyacrylonitrile (PAN) can be stretched as high as 45% in the warp direction with as little as 1–2% shrinkage in the fill direction. Prior processing of this fabric in units in which there was no fill direction restraint resulted in 18–20% width reduction (neck down) and fill direction modulus of the order of $50 \times 10^3$ psi or less. When the material is processed in the apparatus of the invention, the fill direction properties are increased by a factor of at least 2–3.

These and other objects and many attendant advantages of the invention will become apparent as the invention becomes better understood by reference to the following detailed description when considered in conjunction with the accompanying drawings.

DESCRIPTION OF THE PREFERRED EMBODIMENTS

Figure 1:
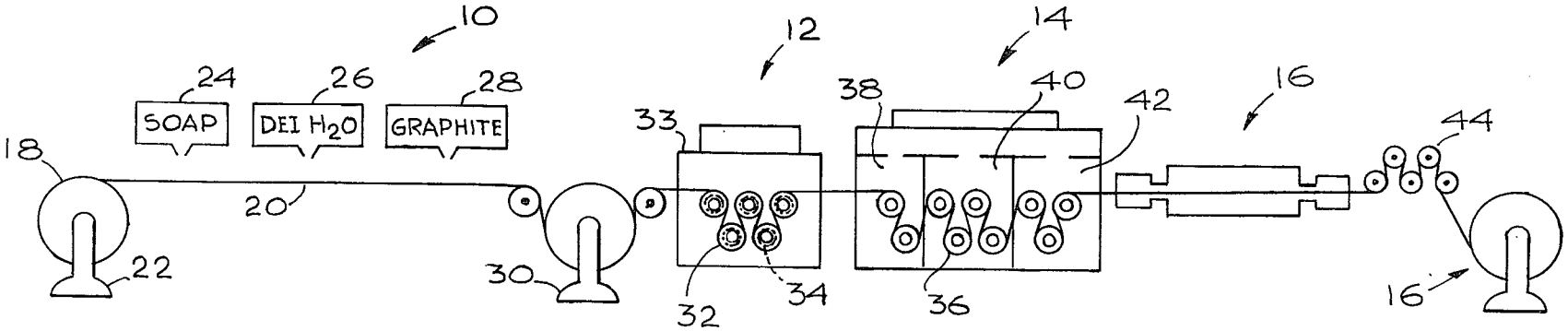
FIG. 1 is a plan view of a system for producing high modulus fabric in accordance with the invention.

High performance carbon-graphite fibers can be prepared from organic precursors such as acrylic polymers, polyvinyl alcohol, regenerated cellulose, pitch materials including petroleum residues, asphalt and coal tars. Highly oriented, synthetic polymer precursors such as acrylic polymers and regenerated cellulose provide better end characteristics. Acrylic precursors do not melt prior to pryolytic decomposition and strength properties of graphitic fibers produced from acrylic precursors are substantially improved over regenerated cellulose based fibers. In addition to strength properties, other physical properties are improved.

The electrical conductivity is approximately five times that for regenerated cellulose based fibers and the degree of graphitization is substantially increased. This results from the fact that acrylic precursors yield a graphitic type of carbon as compared to the non-graphitic type of carbon produced from cellulosic materials. Furthermore, the carbon yield is approximately 45% as compared to only 25% from rayon. The volatiles given off from acrylic precursors do not cause fiber sticking such as occurs from rayon based materials so that yarn flexibility and strength are better. Yarn uniformity is more even and processing problems are fewer.

The acrylic precursors may be homopolymers of acrylonitrile of copolymers produced by copolymerizing not less than 85% of acrylonitrile with not more than 15% of monovinyl compound such as methacrylate, methylmethacrylate, vinyl-acetate, vinylchloride, vinylidine chloride, 2-methyl-5-pyridine or the like.

Many different fabric types may be processed in accordance with the invention and may be single ply or multiple ply. The ratio of warp to fill yarns in the raw state is preferably 2/1 to 5/1. The experiments to be described below utilized a fabric prepared from 2 ply, 800 denier, 34 count warp with 1 ply, 200 denier, 40 picks fill fiber.

The procedure for converting an organic precursor into a high strength, high modulus fiber is rather complex. While much progress has been made in determining structure-property relationships of carbon-graphite materials, there is much remaining to be done in order to understand the effect of production parameters on fiber structure and properties.

The beneficial effects of stretching during various stages of processing has been reported by many workers in this field. Although carbon-graphite fibers are polycrystalline, they exhibit a high degree of preferred orientation which polycrystalline materials do not generally possess. The preferential arrangement of hexagonal graphite crystallites parallel to the fiber axis is responsible for the high strength exhibited by some of the currently available fibers. This high degree of orientation of the crystallites is probably due to the fact that the molecular chains in the precursor are oriented parallel to the fiber axis during stretching and therefore the graphitic nuclei will be more oriented.

Application of stress during some stage of the processing is required to develop high tensile strength levels. Both temperature and stress levels are important. It also has been found that oxidation of carbon-graphite precursor, especially of the acrylic type, prior to carbonization or graphitization is necessary to increase both the strength properties and weight yield of the final product. Stretching or restricting the filaments from shrinking has also been found to be beneficial during preoxidation.

The term preoxidation is not accurately descriptive of this process step since two distinct chemical changes occur in the polymer during this step. Under application of heat, the polymer cyclizes, that is, forms a six member hexagon ring similar to that found in graphite. Heating in an oxygen containing atmosphere allows oxygen to diffuse into the structure of the fiber and forms cross-links or chemical bonds between the polymer chains. It has been fairly well established that the final product characteristics of a graphite yarn or fabric are determined primarily by what happens during the preoxidation step. There are four critical parameters that have to be controlled during preoxidation, i.e., temperature, time, tension or stretch, and atmosphere composition. These parameters are very interrelated and will determine in the preoxidized material the amount of cyclization, cross-linking, oxygen content and orientation.

In accordance with the invention, graphite precursor fabric is continuously processed through the steps of prestretching and preoxidation in single or combined multiple roller units under warp tension by wrapping the fabric no less than 180° around each roll and by minimizing unrestrained inter-roll span.

A general schematic view of an overall system is shown in FIG. 1. The apparatus generally comprises a pretreatment section 10, a stretch unit 12, a preoxidation unit 14 and a firing section 16. In the pretreatment section 10, a roll 18 of fabric 20 is unwound from unwind stand 22 and passes by a washing station 24, rinse station 26 and impregnation station 28 before further processing or before being rewound awaiting treatment in accordance with the invention.

In the washing station 24, the fabric is washed to remove the water-soluble sizing applied by the yarn manufacturer to prevent abrasion of the yarn during handling and weaving. This finish must be removed or it will react with the PAN during oxidation and firing resulting in a brittle, weak product. Washing is effected in a multi-stage unit using a warm soap solution sprayed onto the fabric at 24. A deionized water rinse is sprayed onto the fabric at station 26. The washed fabric is then impregnated with a lubricant such as colloidal graphite at 28 to prevent filament cohesion during further processing. Typically a 4 weight percent colloidal graphite solution is impregnated onto the fabric.

The pretreated fabric is then processed through the remaining train of equipment. The fabric may be initially tensioned at unwind or breaking stand 30 to apply an initial warp tension of about 5 ppi to the fabric 20.

The initial speed may be up to about 35 inches per minute and is usually about 4 to 8 inches per minute. The fabric may be tensioned in a braked roll unit, not shown, up to about 20 to 100 ppi or tension forces may be developed through shrinkage of the fabric as it is processed in the stretch unit. The stretch unit 12 contains a plurality of independently driven rolls 32. Each roll may be driven by a separate variable-speed motor or may be connected by mechanical gearing means to each other such that the rolls are driven at progressively faster speeds to impart incremental positive stretching steps to the fabric 20 as disclosed in U.S. Pat. No. 3,803,672, the disclosure of which is incorporated herein by reference.

The rolls are arranged to provide a wide wrap of fabric at least 180° and the inter-roll span of unrestrained fabric, i.e., the tangential distance between adjacent rolls is no more than 12 inches, preferably from ½ to 3 inches. The combination of the wide wrap of fabric, the warp tension of at least 5 ppi and the controlled small inter-roll span results in significant reduction in the fill direction shrinkage of the fabric while being processed.

The rolls are suitably arranged in alternate rows on spaced axial lines, the axial lines being separated by the radius of a roll to provide an S-wrap. The rolls may be heated by internal resistance heaters 34. It has been learned from experimental runs that extremely high tension levels can be applied to the fabric before oxidation up to an elongation level of about 50% and preferably 20 to 40% without adverse affect, if the tension is permitted to decline as the elongation takes place. It also has been determined that the onset of stretching is about 180° to 200°F at 300 lbs. tension for a 6-inch wide fabric. The onset of stretching may occur at lower temperatures with higher tension.

Though the fabric may be stretched from 0 to 45% with as little as two rolls utilizing one stretch point, it is preferred to practice controlled, step-wise dynamic stretching of the continuously moving fabric under substantially constant elongation conditions. Since the strength of the fabric declines as the temperature is increased, the tension is incrementally reduced. The dynamically moving fabric may be incrementally stretched as the temperature is raised to a temperature of about 400°F and preferably up to about 450°F, the temperature at which cross-linking and cyclization is initiated. The fabric may be heated by means of resistance rod heaters within the rolls or by means of radiation or convection heating of the enclosure 33. The tension at the fabric at the end of dynamic stretching is reduced to low value but about 0 in order to maintain orientation and to prevent fill slippage and shrinkage of the fabric. The tension should usually be below about 20 ppi since the breaking strength is low at this point and the fabric would tear.

The stretched fabric 20 is then subjected to cross-linking in the oxidation unit 14. The temperature in this unit is maintained between about 400°F and about 525°F and may be controlled at constant temperature within that range or may be gradually or incrementally increased to maximum temperature.

Suitably the preoxidation unit 14 is zoned into two or three different compartments 38, 40, 42, at increasingly higher temperature such as 450°, 500° and 525°F. The preoxidation unit 14 may also contain as little as two rolls, the number of rolls being a function of the residence time necessary for stabilization and conversion of the fabric. The rolls 36 are closely spaced and arranged to provide a wide wrap of fabric as in unit 12 and though the warp tension is initially at a low level at the start of preoxidation, the tension builds up to a higher level, typically about 20 to 50 ppi, at the end of oxidation due to shrinkage of the fabric caused by the chemical reaction. The rolls 36 are suitably independently driven at incremental higher speeds as discussed with respect to the rolls 34 in the stretch unit 12.

The preoxidized fabric is processed to suitably contain between about 5 to 25% oxygen, preferably about 12 to 15% oxygen, after treatment and over a typical residence time of 0.5 to 6 hours. The oxygen content may be constant throughout the unit or may be maintained at different levels within the zones 38, 40 and 42. Metal oxidation catalysts may be present in the fabric to increase the rate of oxidation, permitting lower temperatures and/or shorter residence times.

The catalysts may be of the direct metal ion catalysis of air oxidation type such as cobalt, nickel, rhodium, manganese, chromium, copper, silver and cerium or of the type that provide chemically enhanced oxidation. Periodates, peroxides, permanganates, dichromates and perchlorates are typical of the latter type of compounds.

The preoxidized fabric is now cooled to a low temperature below about 100°F, suitably to room temperature and may be retensioned to about 80 ppi before being subjected to firing and graphitization in unit 16. The fabric is then fired at a temperature above about 1500°C up to about 3000°C during graphitization, suitably at about 2750°C for about 0.1 to 10 minutes in an inert atmosphere. A tensioning unit 44 at the end of the unit 16 may be utilized to apply tension up to 80 ppi to the fabric during graphitization. When firing is completed, the fabric is cooled and rewound on a driven rewind stand 46.

Figure 2:
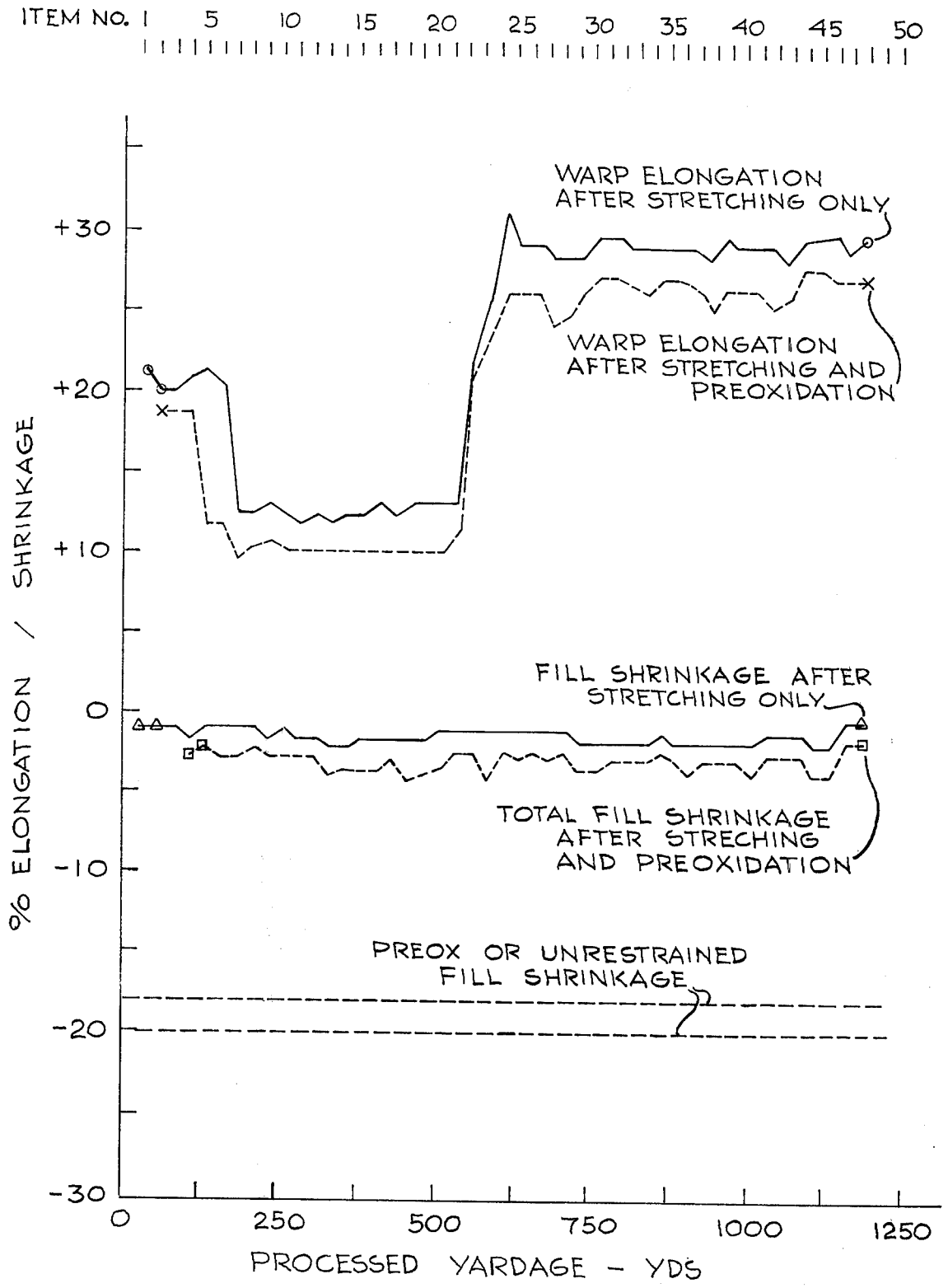
FIG. 2 is a graphical presentation of the effect of warp tension processing on the fill properties of fabric in accordance with the invention.

A sample of 12-inch fabric was subjected to processing in the stretcher unit 12 of FIG. 1 followed by preoxidation under unrestrained conditions and under fill shrinkage restraint conditions in the preoxidation unit 14 of FIG. 1. The results are shown in the following table and in FIG. 2.

Table 1

Stretcher/Preox. Run

| Item No. | Fabric Width Before Stretch/ inch | Fabric Width After Stretch/ inch | % Change | Stretched Warp Elong./% | Preox. Width Change/% |
|---|---|---|---|---|---|
| 1 | 11-7/8 | 11-3/4 | −1.0 | 21.3 | — |
| 2 | 11-7/8 | 11-3/4 | −1.0 | 20.0 | — |
| 3 | 11-7/8 | 11-3/4 | −1.0 | 20.0 | — |
| 4 | 11-7/8 | 11-11/16 | −1.6 | 20.9 | −1.3 |
| 5 | 11-7/8 | 11-3/4 | −1.0 | 21.3 | −1.3 |
| 6 | 11-7/8 | 11-3/4 | −1.0 | 20.6 | −1.9 |
| 7 | 11-7/8 | 11-3/4 | −1.0 | 12.5 | −1.9 |
| 8 | 11-7/8 | 11-3/4 | −1.0 | 12.5 | −1.3 |
| 9 | 11-7/8 | 11-11/16 | −1.6 | 13.1 | −1.3 |
| 10 | 11-7/8 | 11-3/4 | −1.0 | 12.5 | −1.9 |
| 11 | 11-7/8 | 11-11/16 | −1.6 | 11.9 | −1.3 |
| 12 | 11-7/8 | 11-11/16 | −1.6 | 12.5 | −1.3 |
| 13 | 11-15/16 | 11-11/16 | −2.1 | 11.9 | −1.9 |
| 14 | 11-15/16 | 11-11/16 | −2.1 | 12.5 | −1.3 |
| 15 | 11-7/8 | 11-11/16 | −1.6 | 12.5 | −1.9 |
| 16 | 11-15/16 | 11-3/4 | −1.6 | 13.1 | −1.9 |
| 17 | 11-15/16 | 11-3/4 | −1.6 | 12.5 | −1.3 |
| 18 | 11-7/8 | 11-11/16 | −1.6 | 13.1 | −2.5 |
| 19 | 11-15/16 | 11-3/4 | −1.6 | 13.1 | — |
| 20 | 11-15/16 | 11-13/16 | −1.0 | 13.1 | −2.5 |
| 21 | 11-7/8 | 11-3/4 | −1.0 | 13.1 | −1.3 |
| 22 | 11-7/8 | 11-3/4 | −1.0 | 23.1 | −1.3 |
| 23 | 11-7/8 | 11-3/4 | −1.0 | 26.9 | −3.1 |
| 24 | 11-7/8 | 11-3/4 | −1.0 | 31.3 | −1.3 |
| 25 | 11-7/8 | 11-3/4 | −1.0 | 29.4 | −1.9 |

Table 1-continued

Stretcher/Preox. Run

| Item No. | Fabric Width Before Stretch/ inch | Fabric Width After Stretch/ inch | % Change | Stretched Warp Elong./% | Preox. Width Change/% |
|---|---|---|---|---|---|
| 26 | 11-7/8 | 11-3/4 | −1.0 | 29.4 | −1.3 |
| 27 | 11-7/8 | 11-3/4 | −1.0 | 28.8 | −1.9 |
| 28 | 11-7/8 | 11-3/4 | −1.0 | 28.8 | −1.3 |
| 29 | 11-7/8 | 11-11/16 | −1.6 | 28.8 | −1.9 |
| 30 | 11-7/8 | 11-11/16 | −1.6 | 30.0 | −1.9 |
| 31 | 11-7/8 | 11-11/16 | −1.6 | 30.0 | −1.3 |
| 32 | 11-7/8 | 11-11/16 | −1.6 | 29.4 | −1.3 |
| 33 | 11-7/8 | 11-11/16 | −1.6 | 29.4 | −1.3 |
| 34 | 11-7/8 | 11-3/4 | −1.0 | 29.4 | −1.3 |
| 35 | 11-15/16 | 11-3/4 | −1.6 | 29.4 | −1.3 |
| 36 | 11-15/16 | 11-3/4 | −1.6 | 29.4 | −1.9 |
| 37 | 11-15/16 | 11-3/4 | −1.6 | 28.8 | −1.3 |
| 38 | 11-15/16 | 11-3/4 | −1.6 | 30.0 | −1.3 |
| 39 | 11-7/8 | 11-3/4 | −1.6 | 29.4 | −1.3 |
| 40 | 11-15/16 | 11-3/4 | −1.6 | 29.4 | −1.9 |
| 41 | 11-15/16 | 11-3/4 | −1.0 | 29.4 | −1.3 |
| 42 | 11-15/16 | 11-3/4 | −1.0 | 28.8 | −1.3 |
| 43 | 11-15/16 | 11-3/4 | −1.0 | 30.0 | −1.3 |
| 44 | 11-7/8 | 11-11/16 | −1.6 | 30.1 | −1.9 |
| 45 | 11-7/8 | 11-11/16 | −1.6 | 30.1 | −1.9 |
| 46 | 11-3/4 | 11-3/4 | 0 | 29.4 | −1.3 |
| 47 | 11-7/8 | 11-15/16 | 0 | 30.0 | −1.3 |

The warp elongation after stretching varied from about 12% to about 30% while the fill shrinkage was about 1% in all cases. Warp elongation after stretching and preoxidation decreased about 2% due to some shrinkage that occurred. However, fill shrinkage of the unrestrained preoxidized fabric was of the order of 18–20% whereas total fill shrinkage after stretching and preoxidation conducted in the wide wrap, low span unit of the invention was of the order of 1–2%.

Further batch static tests of fabric have shown that the tensile strength is of the order of $200 \times 10^3$ psi for fabric restrained to 0% warp direction shrinkage during stretching and preoxidation. When the same fabric is treated under unrestrained conditions to 20% shrinkage, the tensile strength decreases to $50 \times 10^3$ psi maximum. Therefore, it is believed that the fill direction properties if restrained to 0% shrinkage would provide a tensile strength of $100–150 \times 10^3$ psi and the fill direction of tensile strength for unrestrained, 20% shrinkage conditions, would be $50 \times 10^3$ psi or less. Thus, it is apparent that the process of the invention provides a significant increase in the fill direction properties of the treated fabric.

Figure 3:
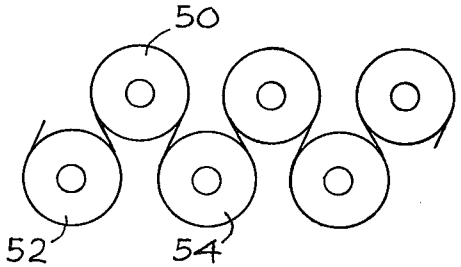
FIG. 3 is a side elevational view of a wide-wrap roller assembly.
Figure 4:
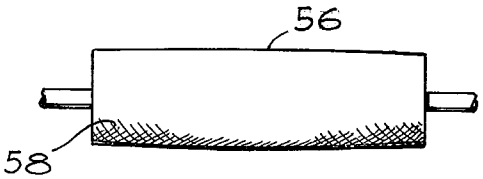
FIG. 4 is a front elevational view of a roughened, convex roller.

Other preferred features of the invention are illustrated in FIGS. 3 and 4. In FIG. 3 a set of independently driven rolls illustrating a 270° wrap are illustrated. Each intermediate roll such as 50 is disposed adjacent to the lead roll 52 and following roll 54 and within a pair of parallel planes drawn through the center lines of the rolls 52 and 54. The rolls are preferably independently driven at incremental higher speeds in order to maintain tension to prevent side-wise slippage of the fabric as it is processed through the unit. In FIG. 4 the roll surface may be slightly convexly shaped as shown in 56 and the surface 58 of the roll may be roughened to increase friction and thus prevent side-wise slippage of the fabric during processing.

Figure 5:
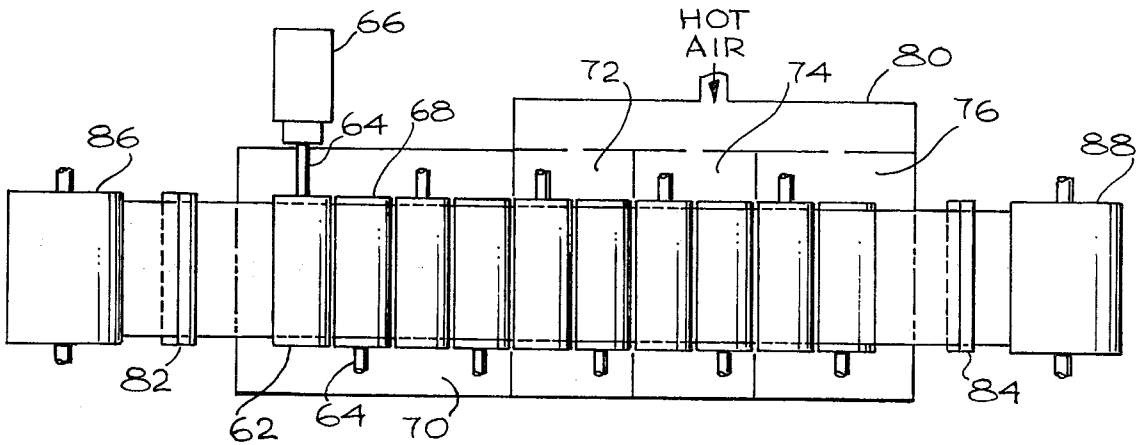
FIG. 5 is a schematic view of a combined stretch-preoxidation unit in accordance with the invention.

Referring now to FIG. 5, the stretch and preoxidation units are combined in a preferred feature of the invention. The combined stretch and preoxidation unit 60 contains a plurality of rolls 62, each independently driven through shaft 64 by a variable speed motor 66. The rolls are closely spaced and positioned with respect to the following roll 68 such that at least a 180° wrap is provided. The unit is preferably zoned into increasingly higher temperature zones such as a first zone 70 in which the fabric is heated from ambient to an initial stretch temperature of about 200°F up to the onset of preoxidation at 450°F. The remainder of the unit is zoned into temperatures of 450°–475°F in zone 72, 475°–500°F in zone 74 and 500°–525°F in zone 76. Hot air from manifold 80 is blown through the fabric in these zones. The fabric is maintained at a tension of at least 5 ppi, preferably at least 10 ppi, by means of brake rolls 82 and tensioning rolls 84. The pretreated fabric unwinds from supply roll 86 and after cooling can be rewound on take-up roll 88 before further processing in the firing and graphitization unit to provide a finished fabric.

In accordance with the invention, the fabric can be stretched as high as 45% of the warp direction with as little as 1–2% shrinkage in the fill direction. The process of the invention provides significantly increased biaxial properties of the fabric and provides a finished product that is approximately 15–18% greater in width than fabric treated under unrestrained conditions with respect to the fill direction.

It is to be realized that only preferred embodiments of the invention have been described, and that numerous substitutions, alterations and modifications are all permissible without departing from the spirit and scope of the invention as defined in the following claims.

What is claimed is:

1. A continuous and dynamic method for developing high biaxial modulus in a woven graphite precursor fabric comprising the steps of:

1. stretching the fabric while heating the fabric to a temperature of at least 175°F;
2. preoxidizing the fabric by heating the fabric to a temperature of at least 400°F and applying an oxidizing atmosphere to the fabric, steps (1) and (2) being conducted while simultaneously applying a warp tension of at least 5 pounds per inch up to the breaking strength of the fabric to the fabric; and passing the tensioned fabric around at least 180° of the alternate upper and lower surfaces of at least two closely spaced rolls, the tangential distance between said rolls being no more than 12 inches and stretching said fabric in the warp direction up to 50% while restraining fill shrinkage to no more than 2%.

2. A method according to claim 1 in which the fabric is wrapped around at least 270° of each roll surface.

3. A method according to claim 2 in which the tangential distance between adjacent rolls is from ½ to 3 inches.

4. A method according to claim 3 in which the warp tension is from 10 to 20 pounds per inch.

5. A method according to claim 1 in which the roll surfaces are arcuate, convexly shaped.

6. An apparatus for continuously processing graphite precursor fabric;

at least two rolls arranged to receive said fabric wrapped over at least 180° of the alternate upper and lower surfaces of adjacent rolls;

roll support means disposed to support the adjacent rolls such that the tangential distance between adjacent rolls is no more than 12 inches;

means to tension the wrapped fabric from at least 5 pounds per inch to below breaking strength to stretch the fabric in the warp direction up to 50% while restraining fill shrinkage to no more than 2%;

means for applying an oxidizing atmosphere to the tensioned heated fabric.

7. An apparatus according to claim 6 in which a plurality of alternate rolls are disposed on axial parallel planes, said rolls being separated by at least the radius of said rolls to provide an S-wrap of fabric through said apparatus.

8. An apparatus according to claim 6 further including independent driver means associated with each roll for driving each roll at a set, predetermined speed.

9. An apparatus according to claim 8 further including independent heating means for heating each roll to a predetermined temperature successively higher than the temperature of the preceding roll.

10. An apparatus according to claim 6 including a first stretching chamber containing at least two of said rolls and roll support means and including first heating means for heating the fabric up to 400°F and a second preoxidation chamber including a second set of said rolls and roll support means and including said applying means and second independent heating means for heating the fabric to a temperature above 400°F.

* * * * *